US008608435B2

(12) United States Patent
Böck

(10) Patent No.: US 8,608,435 B2
(45) Date of Patent: Dec. 17, 2013

(54) TURBO ENGINE

(75) Inventor: Alexander Böck, Kottgeisering (DE)

(73) Assignee: MTU Aero Engines AG, Munich (DE)

( * ) Notice: Subject to any disclaimer, the term of this patent is extended or adjusted under 35 U.S.C. 154(b) by 1133 days.

(21) Appl. No.: 12/514,283

(22) PCT Filed: Oct. 30, 2007

(86) PCT No.: PCT/DE2007/001946
§ 371 (c)(1),
(2), (4) Date: May 8, 2009

(87) PCT Pub. No.: WO2008/055474
PCT Pub. Date: May 15, 2008

(65) Prior Publication Data

US 2010/0003122 A1 Jan. 7, 2010

(30) Foreign Application Priority Data

Nov. 9, 2006 (DE) ..... 10 2006 052 786

(51) Int. Cl.
*F01D 17/12* (2006.01)
*F01D 17/26* (2006.01)
*F01D 11/22* (2006.01)

(52) U.S. Cl.
USPC ..... 415/173.3

(58) Field of Classification Search
USPC ..... 415/14, 30, 47, 173.2, 173.3, 174.1, 415/174.2
See application file for complete search history.

(56) References Cited

U.S. PATENT DOCUMENTS

| | | | | | |
|---|---|---|---|---|---|
| 4,329,114 | A | * | 5/1982 | Johnston et al. | 415/145 |
| 4,472,108 | A | * | 9/1984 | Pask | 415/113 |
| 4,683,716 | A | * | 8/1987 | Wright et al. | 60/226.1 |
| 4,784,569 | A | * | 11/1988 | Sidenstick et al. | 415/173.1 |
| 4,844,688 | A | * | 7/1989 | Clough et al. | 415/116 |
| 4,971,517 | A | * | 11/1990 | Perkey et al. | 415/14 |
| 5,048,288 | A | * | 9/1991 | Bessette et al. | 60/226.1 |
| 5,211,534 | A | | 5/1993 | Catlow | |
| 5,344,284 | A | | 9/1994 | Delvaux et al. | |

FOREIGN PATENT DOCUMENTS

| | | | |
|---|---|---|---|
| DE | 29 22 835 | C2 | 6/1979 |
| DE | 101 17 231 | A1 | 6/2001 |
| DE | 10 2004 037 955 | A1 | 5/2004 |

(Continued)

OTHER PUBLICATIONS

PCT/DE2007/001946, International Search Report and Written Opinion, Sep. 11, 2006.

*Primary Examiner* — Nathaniel Wiehe
*Assistant Examiner* — Sean J Younger
(74) *Attorney, Agent, or Firm* — Howison & Arnott, L.L.P.

(57) ABSTRACT

A turbomachine, especially a gas turbine, includes a rotor having rotating blades and a stator having a housing and guide blades. The rotating blades form at least one rotating blade ring, which at one radially outward lying end adjoins an inner ring or casing ring of the housing, thereby defining a gap therebetween. The casing ring is connected to a support ring via curved walls, which together with the casing ring and the support ring bound a cavity and form a bellowslike structure. By changing the pressure prevailing in the cavity of the respective bellowslike structure, the gap between the casing ring and the radially outward lying ends of the respective rotating blade ring can be pneumatically adjusted.

4 Claims, 3 Drawing Sheets

(56) References Cited

FOREIGN PATENT DOCUMENTS

| | | | |
|---|---|---|---|
| FR | 2 458 676 | A | 1/1981 |
| GB | 2 195 715 | A | 4/1988 |
| JP | 58 020904 | A | 2/1983 |
| JP | 62 142808 | A | 6/1987 |

* cited by examiner

TURBO ENGINE

CROSS-REFERENCE TO RELATED APPLICATIONS

This application is a U.S. National Phase application submitted under 35 U.S.C. §371 of Patent Cooperation Treaty application serial no. PCT/DE2007/001946, filed Oct. 30, 2007, and entitled TURBO ENGINE, which application claims priority to German patent application serial no. DE 10 2006 052 786.0, filed Nov. 9, 2006, and entitled TURBOMASCHINE, the specifications of which are incorporated herein by reference in their entireties.

TECHNICAL FIELD

The invention concerns a turbo engine, especially a gas turbine.

BACKGROUND

From DE 10 2004 037 955 A1 there is a known turbo engine with a stator and a rotor, wherein the rotor has rotating blades and the stator has a housing and guide blades. The rotating blades at the rotor side form at least one rotating blade ring, which at one radially outward lying end adjoins a radially inward lying wall of the housing, by which it is surrounded and with which it bounds a radial gap. The radially inward lying wall of the housing is also known as the inner ring or casing ring and serves in particular as the substrate for a run-in coating. Furthermore, from DE 10 2004 037 955 A1 it is known that the gap between the casing ring of the housing and the radially outward lying end of the rotating blade ring or each rotating blade ring can be adjusted or adapted in its size by servomechanisms to provide a so-called Active Clearance Control, so as to automatically influence the gap and ensure an optimal gap maintenance over all operating conditions. According to DE 10 2004 037 955 A1, the radially inward lying housing wall or the casing ring is segmented in the circumferential direction, and preferably each segment is assigned a separate servomechanism. The servomechanisms are preferably electromechanical actuators.

DE 101 17 231 A1 discloses a turbo engine with a stator and a rotor, wherein the gap between radially outward lying ends of the rotating blades and the radially inward lying housing wall can be adjusted by means of a pneumatic, i.e., pressurized air-operated, actuator unit of a rotor gap control module. The pneumatic actuator unit of the rotor gap control module disclosed there has an actuator chamber, a pressure chamber, and valves connecting the actuator chamber and the pressure chamber, and depending on the pressure prevailing in the actuator chamber sealing elements of the rotor gap control module are inflated so as to adjust or adapt the size of the gap between radially outward lying ends of rotating blades and the casing ring of the housing in the sense of a pneumatic Active Clearance Control.

DE 29 22 835 C2 and U.S. Pat. No. 5,211,534 disclose further turbo engines with a pneumatic or pressurized air-operated Active Clearance Control.

Thus, the turbo engine of DE 29 22 835 C2 has a stator and a rotor, while the gap between radially outward lying ends of the rotating blades and an inner ring or casing ring of a housing wall can be pneumatically adjusted. For this, the casing ring is connected to a support ring via flexible sidewalls, with the casing ring, the support ring and the side walls forming a bellows-like structure. By adjusting the pressure in a cavity defined by the bellows-like structure, the gap between radially outward lying ends of the rotating blades and the casing ring can be adjusted. The flexible sidewalls of DE 29 22 835 C2 are curved several times. Accordingly, seen in the axial direction, the sidewalls of DE 29 22 835 C2 curve inward into the cavity for some segments and outward from the cavity for some segments.

SUMMARY

Starting from the previously discussed background, the problem of the present invention is to create a new kind of turbo engine with a pneumatic Active Clearance Control.

According to a first aspect of the invention, a turbo engine is provided, wherein, in the region of the bellows-like structure or each bellows-like structure, the wall connecting the casing ring to the support ring is curved only once inwardly into the respective cavity, looking in the axial direction.

According to a second aspect of the invention, a turbo engine is provided, wherein, in the region of the bellows-like structure or each bellows-like structure, the wall connecting the casing ring to the support ring is curved only once outwardly from the respective cavity, looking in the axial direction.

BRIEF DESCRIPTION OF THE DRAWINGS

Preferred modifications of the invention will emerge from the subclaims and the following description. Sample embodiments of the invention are explained more closely by means of the drawing, without being restricted to these. This shows:

DETAILED DESCRIPTION

Figure 1:
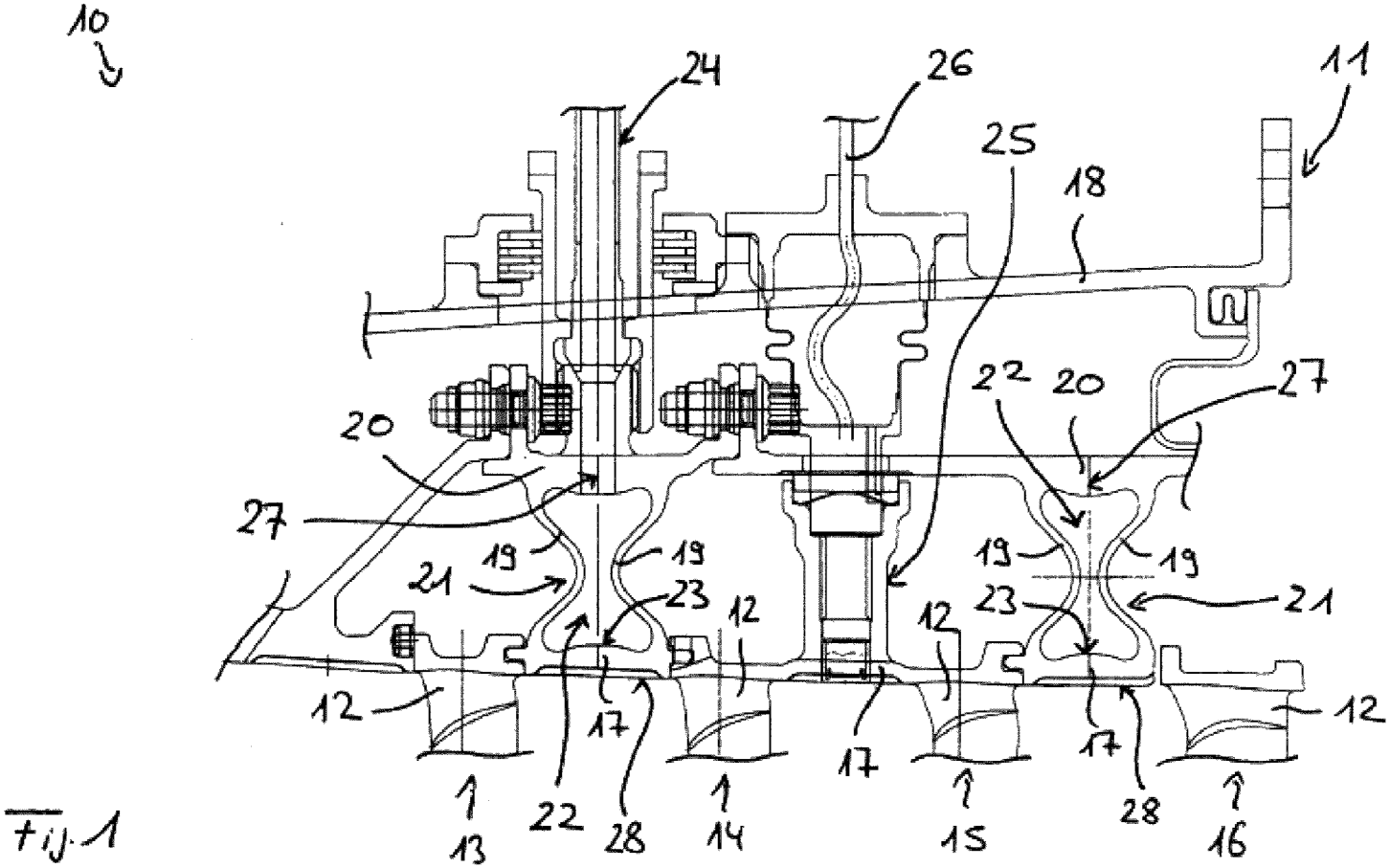
FIG. 1, a cross section through subassemblies at the stator side of a turbo engine according to the invention.

FIG. 1 shows a partial cross section through a stator of a compressor 10 of a turbo engine, wherein the stator comprises a housing 11 as well as several stationary guide blades 12. The guide blades 12 on the stator side form so-called guide blade rings, which are arranged one behind the other looking in the axial direction. FIG. 1 shows a total of four stationary guide blade rings 13, 14, 15 and 16 at the stator side.

Figure 4:
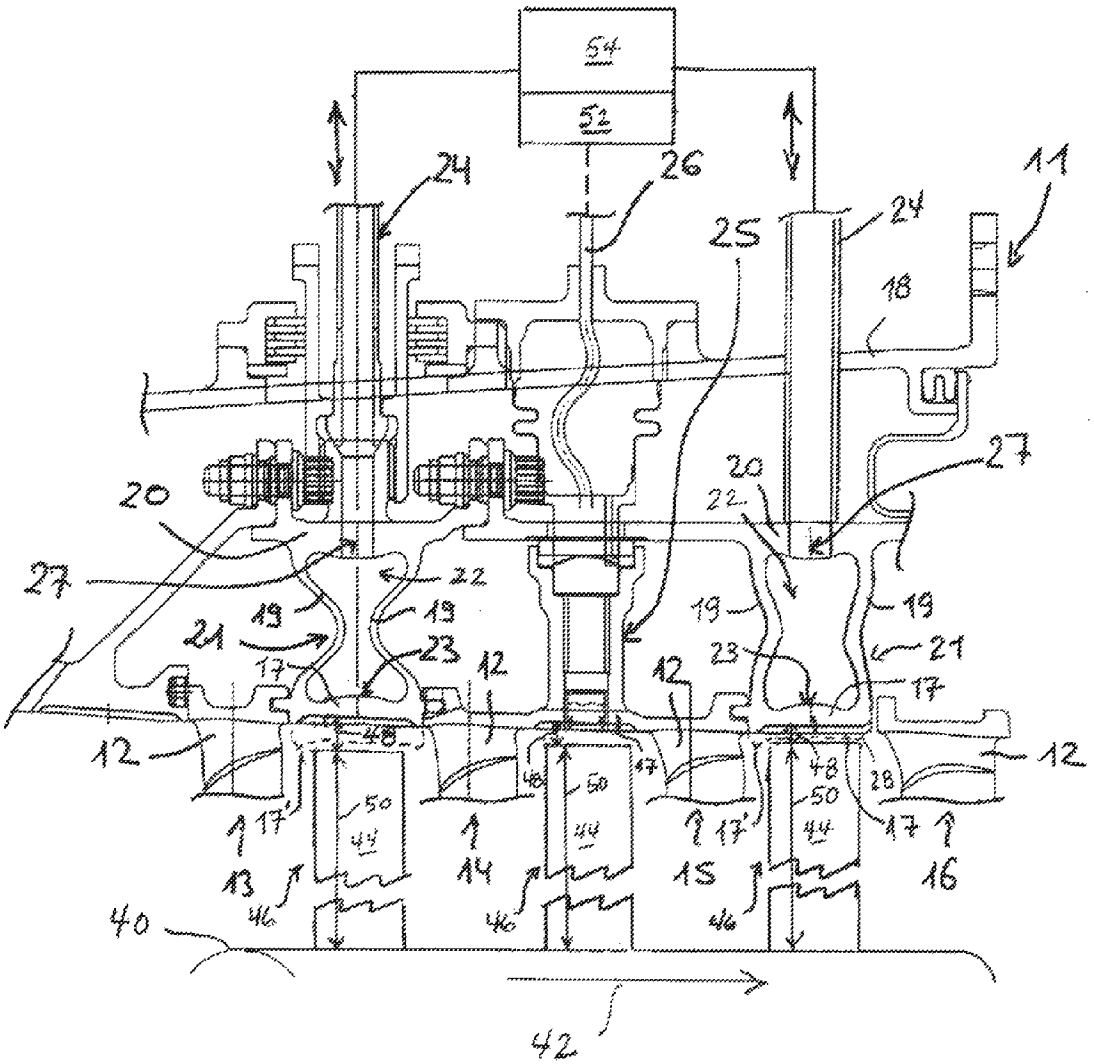
FIG. 4, a cross section of a turbo engine in according with an alternative embodiment.

Besides the stator, the compressor 10 contains a rotor 40 not shown in FIG. 1, the rotor being formed from several rotor disks, not shown, arranged one behind the other in axial direction 42, each rotor disk carrying several rotating blades 44, likewise not shown, alongside each other in the circumferential direction (see FIG 4). The rotating blades assigned to one rotor disk and arranged alongside each other in the circumferential direction form so-called rotating blade rings, while between every two neighboring guide blade rings 13 and 14, 14 and 15, and 15 and 16, there is arranged a respective rotating blade ring 46, not shown.

Besides the stator, the compressor 10 contains a rotor 40 not shown in FIG. 1, the rotor being formed from several rotor disks, not shown, arranged one behind the other in axial direction 42, each rotor disk carrying several rotating blades 44, likewise not shown, alongside each other in the circumferential direction (see FIG. 4). The rotating blades assigned to one rotor disk and arranged alongside each other in the circumferential direction form so-called rotating blade rings 46, while between every two neighboring guide blade rings 13 and 14, 14 and 15, and 15 and 16, there is arranged a respective rotating blade ring 46 (see FIG. 4).

The housing 11 of the stator of the compressor 10 comprises a radially inward lying housing wall, while the radially inward lying housing wall forms a so-called inner ring or casing ring in the region of each rotating blade ring 46 at the rotor side, not shown in FIG. 1, and encloses the respective rotating blade ring 46 radially on the outside. Besides the casing rings 17 of the radially inward lying housing wall, the housing 11 further comprises a radially outward lying housing wall 18.

As already mentioned, the radially inward lying housing wall forms a so-called casing ring 17 in the region of each rotating blade ring at the rotor side (not shown), which encloses the rotating blade ring radially on the outside. Thus, between the radially outward lying ends of the rotating blades 44 of each rotating blade ring 46 and the respective casing ring 17 is formed a radial gap 48 (FIG. 4), which is subject to considerable changes during the operation of the compressor, since on the one hand the rotating blades and the respective casing rings have different thermal behavior and on the other hand the rotating blades undergo a change in length 50 due to the centrifugal forces at work during operation.

It is quite difficult to maintain definite dimensions of the respective gap between the radially outward lying ends of the rotating blades of a rotating blade ring and the respective casing ring 17 during operation, yet it is of critical importance for optimized efficiency.

The present invention concerns only those details which can be used to exactly maintain radial gaps between radially outward lying ends of rotating blade rings and the respective casing ring 17.

Per FIG. 1, the casing rings 17 which extend between the guide blade rings 13 and 14, as well as 15 and 16, are connected by curved and elastically flexible walls 19 to a support ring 20, the respective support ring 20 being arranged between the respective casing ring 17 and the radially outward lying housing wall 18. The respective casing ring 17, the support ring 20, and the curved walls 19 extending between the respective casing ring 17 and the respective support ring 20 form a bellows-like structure 21, having a cavity 22. The bellows-like structure 21 and thus the cavity 22 fully surrounds and thereby encloses the rotating blade ring, looking in the circumferential direction.

By changing a pressure prevailing in the respective cavity 22 of the bellows-like structure 21, the gap 48 between the respective casing ring 17 and the radially outward lying end of the respective rotating blade ring 46 can be adjusted pneumatically. If the pressure is increased in the cavity 22 of the respective bellows-like structure 21, the respective radially inward lying casing ring 17 can be forced radially inward and the respective radially outward lying support ring 20 radially outward. By reducing the pressure in the cavity 22 of the respective bellows-like structure 21, an opposite deformation of the respective bellows-like structure 21 can be accomplished.

In the preferred embodiment of FIG. 1, the curved and elastically flexible walls 19 of the bellows-like structures 21 are curved only one time inward into the respective cavity 22, looking in the axial direction. In the region of a vertex of the curve, wall segments of the respective wall 19 subtend a relatively obtuse angle $\alpha$ larger than 90 degrees. This is described hereafter in reference to FIG. 2, which shows a schematic representation of a bellows-like structure 21.

Figure 2:
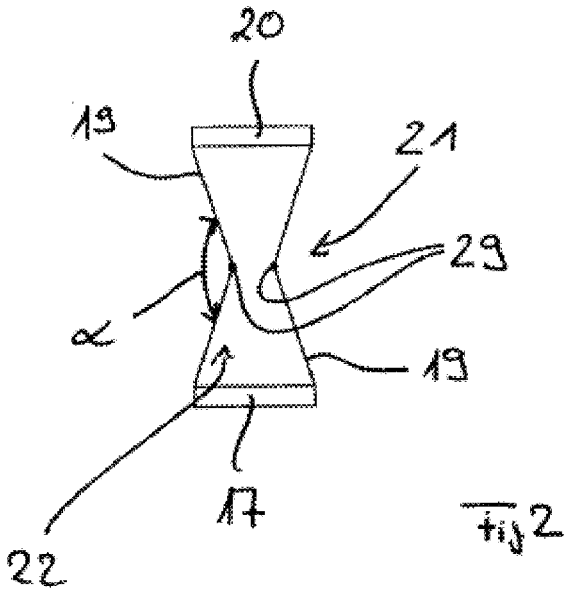
FIG. 2, a schematic representation of a bellows-like structure of the turbine per FIG. 1.

Thus, FIG. 2 shows that in the region of a vertex 29 of the curve, the wall segments of the respective wall 19 subtend an obtuse angle $\alpha$. For such curved walls 19, two effects are superimposed when the pressure increases in the respective cavity 22 of the respective bellows-like structure 21.

First, due to the pressure rise in the cavity 22, the respective casing ring 17 and the respective support ring 20 are forced apart, looking directly in the radial direction. Secondly, this radial forcing apart of the casing ring 17 and support ring 20 is supported or at least not hindered by a toggle-like effect of the curved walls 19. The curved walls 19 are essentially subjected only to compressive forces.

According to FIGS. 1 and 2, the bellows-like structure 21 has a greater radial dimension than its axial dimension. Preferably, the walls 19 of the bellows-like structure 21 have a greater radial dimension than their axial dimension.

In the sample embodiment shown in FIG. 1, the curved walls 19 of each bellows-like structure 21 have a roughly constant wall thickness, looking in the radial direction. In contrast to this, it is also possible for the curved walls 19 to have a variable wall thickness, looking in the radial direction.

As can likewise be seen from FIG. 1, the radially inward lying casing ring 17 of each bellows-like structure 21 has a smaller wall thickness that the respective radially outward lying support ring 20. The support ring 20 of each bellows-like structure 21 is accordingly designed with a greater wall thickness than the respective casing ring 17. This ensures that deformations of the bellows-like structure 21 brought about by change of pressure prevailing in the particular cavity 22 act primarily on the casing ring 17.

Moreover, one can infer from FIG. 1 that the casing ring 17 of each bellows-like structure 21 has a radially outward curved contour 23, protruding into the respective cavity 22, in a middle region, looking in the axial direction.

Thanks to this, upon deformation of the casing ring 17 due to a pressure change in the cavity 22 of the respective bellows-like structure 21, an outer contour 28 of the casing ring 17 is displaced essentially only parallel, looking in the radial direction, so that a gap between the casing ring 17 and the rotating blade ring can be adjusted exactly.

Each bellows-like structure 21 is coordinated with at least one pressurized air line 24, in order to either bring pressurized air into the cavity 22 of the respective bellows-like structure 21 or drain pressurized air from it. For an easier representation, FIG. 1 shows one such pressurized air line 24 only for the bellows-like structure 21 positioned between the two guide blade rings 13 and 14, looking in the axial direction. Each bellows-like structure 21 is coordinated with at least one such pressurized air line 24. The more such pressurized air lines 24 are present per bellows-like structure 21, the quicker pressurized air can be taken to or drained from the respective cavity 24.

In the sample embodiment of FIG. 1, one bellows-like structure 21 is arranged between the two guide blade rings 13 and 14, and also between the two guide blade rings 15 and 16, while no such bellows-like structure is present between the two guide blade rings 14 and 15. Instead, according to FIG. 1, a sensor unit 25 is arranged between the two guide blade rings 14 and 15 and, thus, in the region of a rotating blade ring arranged between the former.

With the sensor unit 25, one can measure at least the radial dimension of the gap 48 between the corresponding rotating blade ring 46 and the casing ring 17 surrounding this rotating blade ring. Via a signal line 26, the sensor unit 25 transmits the corresponding actual value to a feedback control mechanism 52 (FIG. 4) where the feedback control mechanism compares the actual value against a setpoint and, depending on this, adjusts the pressure prevailing in the cavities 22 of the bellows-like structures 21 so that the actual value comes near the setpoint.

It can be provided that the pressurized air feed to the cavities 22 and the pressurized air drain from the cavities 22 of the bellows-like structures 21 can be adjusted by individual valves, in order to individually adjust the pressure prevailing in the cavities 22 of the two bellows-like structures 21 and thus individually adjust the dimension of the radial gap between the casing ring 17 and the corresponding rotating blade ring as a function of the respective radial dimension of the rotating blade ring.

Alternatively, as best seen in FIG. 4, it can be provided to adjust the pressurized air feed 24 to the cavities 22 of the bellows-like structures 21 and the pressurized air drain from same by a common valve 54. Different deformations of the bellows-like structures 21 required due to different radial dimensions 50 of the particular rotating blade ring 46 of the compressor 10 can then be achieved by an adapted curvature of the curved walls 19 and/or an adapted wall thickness of the curved walls 19 and/or by an adapted radial dimension of the bellows-like structures 21. For example, in the embodiment shown in FIG. 4, the profiles of the first curved walls 19 disposed between guide rings 13 and 14 are adapted to produce a different deformation of the associated bellows-like structure 21 (denoted by deformed casing ring 17', shown in broken line) than the profiles of the second curved walls 19 disposed between guide rings 15 and 16 produce in the associated bellows-like structure 21. In particular, the curvature of the curved walls 19 of the bellows-like structure 21 disposed between guide rings 13 and 14 is different (i.e., greater than) than the curvature of the curved walls 19 of the bellows-like structure 21 disposed between guide rings 15 and 16. Further, the wall thickness of the curved walls 19 of the bellows-like structure 21 disposed between guide rings 13 and 14 is different (i.e., less than) than the wall thickness of the curved walls 19 of the bellows-like structure 21 disposed between guide rings 15 and 16. These differences between the profiles of the first curved walls 19 disposed between guide rings 13 and 14 and the profiles of the second curved walls 19 disposed between guide rings 15 and 16 result in different deformations of the respective bellows-like structures 21.

According to FIG. 1, the two bellows-like structures 21 are divided in the axial direction by dividing planes extending in the radial direction, and the two axial halves of the bellows-like structures 21 are welded together during the fabrication process. Alternatively, it is also possible to divide the bellows-like structures 21 in the radial direction.

According to FIGS. 1 and 2, each wall 19 in the region of each bellows-like structure 21 is curved only once inward into the respective cavity 22, looking in the axial direction.

Figure 3:
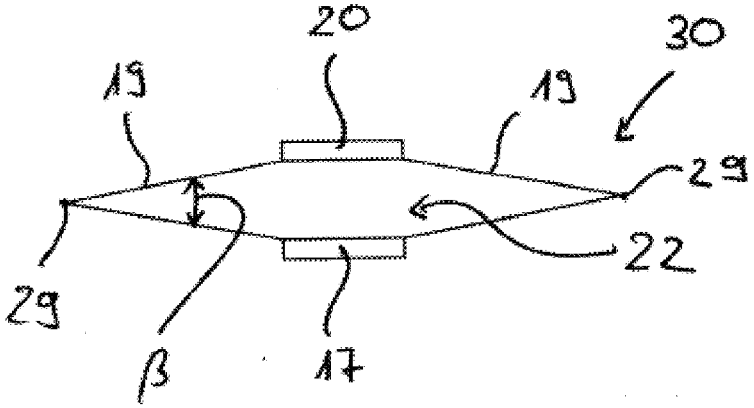
FIG. 3, a schematic representation of an alternative bellows-like structure of a turbo engine.

In contrast with this, it is also possible, as diagrammed in FIG. 3, for each curved, elastically flexible wall 19 in the region of each bellows-like structure 30 to be curved only once outward from the respective cavity 22, looking in the axial direction. Wall segments of the respective wall 19 in the region of a vertex 29 of the curvature subtend a relatively acute angle β smaller than 90 degrees.

According to FIG. 3, the wall segments of the wall 19 subtending the angle β extend basically in the axial direction. Like the casing ring 17 and the support ring 21, they are exposed to the pressure prevailing in the cavity 22 and thereby support a radial moving apart of the casing ring 17 and support ring 20 when pressure increases in the cavity 22. A negative toggle effect in this variant is also totally eliminated by the acute angle β.

The bellows-like structure 30 per FIG. 3 has a larger axial dimension than its radial dimension; in particular, the walls 19 of the bellows-like structure 30 have a larger axial dimension than their radial dimension.

The invention claimed is:

1. A gas turbine comprising:

a stator having a housing and guide blades;

the housing defining an axial direction and including annular first, second and third casing rings and annular first and second support rings;

the first casing ring being disposed within the first support ring and connected to the first support ring via a pair of spaced-apart first curved walls, which first curved walls together with the first casing ring and the first support ring bound a first cavity and form a first bellows-like structure, each of the first curved walls having only a single curve in the axial direction in the region of the first bellows-like structure;

the second casing ring being axially spaced-apart from the first casing ring and disposed within the second support ring and connected to the second support ring via a pair of spaced-apart second curved walls, which second curved walls together with the second casing ring and the second support ring bound a second cavity and form a second bellows-like structure, each of the second curved walls having only a single curve in the axial direction in the region of the second bellows-like structure;

the third casing ring being axially disposed between the first and second casing rings;

a first rotor having a plurality of rotating blades disposed within the housing;

the rotating blades forming a first blade ring disposed within the first casing ring;

the radially outward lying ends of the blades forming the first blade ring being radially adjacent to the surrounding first casing ring and defining a first radial gap therebetween;

a second rotor having a plurality of rotating blades disposed within the housing;

the rotating blades forming a second blade ring disposed within the second casing ring;

the radially outward lying ends of the blades forming the second blade ring being radially adjacent to the surrounding second casing ring and defining a second radial gap therebetween;

a third rotor having a plurality of rotating blades disposed within the housing;

the rotating blades forming a third blade ring disposed within the third casing ring;

the radially outward lying ends of the blades forming the third blade ring being radially adjacent to the surrounding third casing ring and defining a third radial gap therebetween;

a first pressurized air source and drain operatively connected to the first bellows-like structure and adapted to change the prevailing pressure within the first cavity, whereby a change in the prevailing pressure within the first cavity will selectively deform the first bellows-like structure to change the first radial gap between the first blade ring and the first casing ring;

a second pressurized air source and drain operatively connected to the second bellows-like structure and adapted to change the prevailing pressure within the second cavity, whereby a change in the prevailing pressure within the second cavity will selectively deform the second bellows-like structure to change the second radial gap between the second blade ring and the second casing ring;

a sensor unit operatively connected to the third casing ring, the sensor unit adapted to measure the third radial gap between the third blade ring and the third casing ring and transmit a first value corresponding to a radial dimension of the third radial gap;

a feedback control mechanism operatively connected to the first and second pressurized air sources and drains and to the sensor unit, the feedback control mechanism adapted to receive the first value corresponding to the radial dimension of the third radial gap, compare the first value to a second value corresponding to a desired value, and depending on the difference between the first value and the second value, adjust the pressure prevailing in the first and second cavities of the first and second bellows-like structures so that the first value subsequently moves toward the desired value;

wherein the feedback control mechanism includes a common valve operatively connected to the first and second pressurized air sources and drains for adding and releasing air from the first and second cavities to maintain the same prevailing pressure within the cavities; and wherein the first blade ring has a first radial dimension and the second blade ring has a second radial dimension that is different from the first radial dimension;

the first curved walls of the first bellows-like structure have a first profile and the second curved walls of the second bellows-like structure have a second profile that is different from the first profile; and the first and second profiles being selected to produce different deformations of the first and second bellows-like structures in response to changes in the same prevailing pressure within the first and second cavities, whereby the different radial dimensions of the first and second rotating blade rings are accommodated.

2. A gas turbine in accordance with claim 1, wherein the first and second profiles are characterized by different curvatures of the first curved walls compared to the second curved walls, taken in the axial direction.

3. A gas turbine in accordance with claim 1, wherein the first and second profiles are characterized by different wall thicknesses of the first curved walls compared to the second curved walls, taken in the axial direction.

4. A gas turbine comprising:

a stator having a housing and guide blades;

the housing defining an axial direction and including annular first, second and third casing rings and annular first and second support rings;

the first casing ring being disposed within the first support ring and connected to the first support ring via a pair of spaced-apart first curved walls, which first curved walls together with the first casing ring and the first support ring bound a first cavity and form a first bellows-like structure;

the second casing ring being axially spaced-apart from the first casing ring and disposed within the second support ring and connected to the second support ring via a pair of spaced-apart second curved walls, which second curved walls together with the second casing ring and the second support ring bound a second cavity and form a second bellows-like structure;

the third casing ring being axially disposed between the first and second casing rings;

a first rotor having a plurality of rotating blades disposed within the housing;

the rotating blades forming a first blade ring disposed within the first casing ring;

the radially outward lying ends of the blades forming the first blade ring being radially adjacent to the surrounding first casing ring and defining a first radial gap therebetween;

a second rotor having a plurality of rotating blades disposed within the housing;

the rotating blades forming a second blade ring disposed within the second casing ring;

the radially outward lying ends of the blades forming the second blade ring being radially adjacent to the surrounding second casing ring and defining a second radial gap therebetween;

a third rotor having a plurality of rotating blades disposed within the housing;

the rotating blades forming a third blade ring disposed within the third casing ring;

the radially outward lying ends of the blades forming the third blade ring being radially adjacent to the surrounding third casing ring and defining a third radial gap therebetween;

a first pressurized air source and drain operatively connected to the first bellows-like structure and adapted to change the prevailing pressure within the first cavity, whereby a change in the prevailing pressure within the first cavity will selectively deform the first bellows-like structure to change the first radial gap between the first blade ring and the first casing ring;

a second pressurized air source and drain operatively connected to the second bellows-like structure and adapted to change the prevailing pressure within the second cavity, whereby a change in the prevailing pressure within the second cavity will selectively deform the second bellows-like structure to change the second radial gap between the second blade ring and the second casing ring;

a sensor unit operatively connected to a selected one of the first, second and third casing rings, the sensor unit adapted to measure the associated radial gap between the selected one of the casing rings and the associated blade ring and transmit a first value corresponding to a radial dimension of the associated radial gap;

a feedback control mechanism operatively connected to the first and second pressurized air sources and drains and to the sensor unit, the feedback control mechanism including a common valve operatively connected to the first and second pressurized air sources and drains for adding and releasing air from the first and second cavities to maintain the same prevailing pressure within the cavities, the feedback control mechanism being adapted to receive the first value corresponding to the radial dimension of the associated radial gap, compare the first value to a second value corresponding to a desired value, and depending on the difference between the first value and the second value, adjust the pressure prevailing in the first and second cavities of the first and second bellows-like structures so that the first value subsequently moves toward the desired value;

wherein the first blade ring has a first radial dimension and the second blade ring has a second radial dimension that is different from the first radial dimension;

the first curved walls of the first bellows-like structure have a first profile and the second curved walls of the second bellows-like structure have a second profile that is different from the first profile; and the first and second profiles being selected to produce different deformations of the first and second bellows-like structures in response to changes in the same prevailing pressure within the first and second cavities, whereby the different radial dimensions of the first and second rotating blade rings are accommodated.

* * * * *